US006455993B1

(12) United States Patent
Ito

(10) Patent No.: US 6,455,993 B1
(45) Date of Patent: Sep. 24, 2002

(54) SHADOW MASK TYPE COLOR CATHODE RAY TUBE HAVING VARIABLE APERTURE DIAMETER

(75) Inventor: Hiroshi Ito, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/353,366

(22) Filed: Jul. 15, 1999

(30) Foreign Application Priority Data

Jul. 16, 1998 (JP) ..... 10-201881

(51) Int. Cl.[7] ..... H01J 29/81; H01J 29/07

(52) U.S. Cl. ..... 313/408; 313/402

(58) Field of Search ..... 313/402, 403, 313/404, 405, 406, 407, 408

(56) References Cited

U.S. PATENT DOCUMENTS 3,652,895 A * 3/1972 Tsuneta et al. ..... 313/85 S
5,616,985 A * 4/1997 Hosotani et al. ..... 313/403

* cited by examiner

*Primary Examiner*—Nimeshkumar D. Patel
*Assistant Examiner*—Karabi Guharay
(74) *Attorney, Agent, or Firm*—Mattingly, Stanger & Malur, P.C.

(57) ABSTRACT

The shadow mask equipped for a shadow mask type color cathode ray tube of this invention is placed in order to face in the inside of panel portion having a fluorescent screen. The original plate with a porous portion of substantially rectangle state which establish a large number of electron beam passage holes is pressed is shaped. The diameter of the electron beam passage holes is smaller in the four corner regions than the center region of the porous portion. The width of the bridge which connects electron beam passage holes which adjoins for the oblique direction is bigger in four corner regions than the center region of porous portion. Therefore, the strength of the corner region of porous portion rises, as compared to the prior art, as it is close to the corner edge. As the result, the extension deformation of the aperture is suppressed, even if the considerably big transformability is applied in dot state electron beam passage holes in the corner region in composing the shadow mask unitedly by press shaping.

14 Claims, 4 Drawing Sheets

SHADOW MASK TYPE COLOR CATHODE RAY TUBE HAVING VARIABLE APERTURE DIAMETER

BACKGROUND OF THE INVENTION

This invention concerns a color cathode ray tube with a shadow mask.

Color cathode ray tubes are used for displays for terminal monitors and TV receivers, etc. Generally, a color cathode ray tube includes the following components:

(1) Vacuum envelope made of the glass including a panel portion, a neck portion, and a funnel portion.

(2) Fluorescent screen formed in the inner surface of the face plate of the panel portion.

(3) Shadow mask that faces the fluorescent screen inside of the panel portion.

(4) Electron gun in the neck portion.

(5) Deflection yoke fixed in the circumference of the funnel portion.

With large number of dots state electron beam passage holes, the shadow mask contains a rectangle porous portion with a fixed curved surface, a nonporous rectangle frame portion with a whole circumference porous edge portion and an equal curved surface with the porous portion, and bent skirt portion which trails from all the peripheral of the nonporous portion. By pressing and shaping the metallic material for the shadow mask composition, the porous portion, nonporous portion and skirt portion are united.

SUMMARY OF THE INVENTION

The inventors have found that an elongation of the diameter of the dot state electron beam passage holes increases in the marginal region of porous portion in comparison with center region of porous portions, when the shadow mask was composed unitedly by the press shaping. That is to say, dot transformability which is applied in the dot state electron beam passage hole is bigger in marginal region of porous portion than in center region of porous portion, due to the press shaping. Therefore, the diameter of dot state electron beam passage holes greatly increases by applying large transformability in each corner region especially in the marginal region of porous portion in comparison with center region of porous portion.

In the display monitor for an information processing terminal such as the computer, there tends to be a year by year increase of the display image high resolution. In color cathode ray tube for such display monitor, high-definition of the phosphor pixel (dot) which constitutes the fluorescent screen is required. That is to say, it is necessary to make the interval (pitch) of the phosphor dot small. Like this, it is necessary to make the interval (pitch) in the electron beam passage hole of the dot state of the shadow mask small in order to provide a fluorescent screen of color cathode ray tube of high-definition.

Electron beam cross-sectional shape expands especially in the corner region of the peripheral region of the fluorescent screen of the color cathode ray tube, when the shadow mask in which the diameter of the aforesaid dot state electron beam passage hole increases was used in color cathode ray tube of such high-definite screen. The phenomenon which also irradiates not only the fluorescent body which should originally shine but also adjoining fluorescent body arises by this. By reducing the interval (pitch) of electron beam passage holes in the shadow mask and the interval (pitch) of phosphor dot in the fluorescent screen, this is as the electron beam becomes easy to reach to adjacency fluorescence body dot. Landing tolerance of the electron beam lowers, and the color purity of the image displayed in color cathode ray tube deteriorates, and it is not possible to display the high-quality image.

Since it was not needed to reduce the interval (pitch) of phosphor dot and shadow mask electron beam passage holes without requiring high-definition of fluorescent screen in color cathode ray tube for the public TV receiver, landing tolerance lowering of the superscription electron beam was not doubted.

An object of the invention is to reduce the deformation of the dot state electron beam passage hole which is located in the corner region of the porous portion in the press shaping of the shadow mask to solve the aforesaid problem, and offer a shadow mask type color cathode ray tube which enables the display of the high-quality image.

The shadow mask type color cathode ray tube by this invention contains the following composition in order to achieve the aforesaid purpose.

The envelope equipped for shadow mask type color cathode ray tube of this invention includes panel portion with face plate, neck portion, and funnel portion which connects panel portion with neck portion.

The fluorescent screen equipped for shadow mask type color cathode ray tube of this invention is formed in the inner surface of face plate.

The electron gun equipped for shadow mask type color cathode ray tube of this invention is stored in neck portion.

The deflecting yoke equipped for shadow mask type color cathode ray tube of this invention is fixed in the circumference (the neck portion approach) of funnel portion.

The shadow mask equipped for shadow mask type color cathode ray tube of this invention is placed in order to face the inside of panel portion with fluorescent screen, and the original plate with porous portion of substantially rectangle state which established large number of electron beam passage holes is being pressed and is being shaped.

The diameter of the electron beam passage holes is smaller in the four corner regions than the center region of the porous portion.

Or, the width of the bridge which connects electron beam passage holes which adjoins for the oblique direction is bigger in four corner regions than the center region of porous portion.

And, shadow mask type color cathode ray tube by this invention may include following composition in order to achieve the aforesaid purpose.

(means 1A) In the shadow mask original plate before it is shaped, the diameter of the electron beam passage holes decreases by the power 1.5 of the distance of the direction which approaches the corner edge in a first range of substantially quadrangular state surrounded by a next four points from a reference point.

(1) Each corner edge of porous portion.

(2) Reference point which left several mm along the diagonal line in the central direction from the each corner edge of porous portion.

(3) Horizontal peripheral line edge of porous portion which is horizontally from reference point in reverse direction for the perpendicular center line of porous portion.

(4) Perpendicular peripheral line edge of porous portion which is perpendicular from reference point in reverse direction for the level center line of porous portion.

(means 1B) In the shadow mask, before pressing and shaping the original plate the width of the bridge increases by the power 1.5 of the distance of the direction which approaches the corner edge in the first range from the reference point.

And, shadow mask type color cathode ray tube by this invention may include following composition in order to achieve the aforesaid purpose.

(means 2A) In addition to aforesaid means 1A, the diameter of the electron beam passage hole proportionally increases in the second range of substantially quadrangular state surrounded by next 4 points in the second reference point direction from reference point side.

(1) Reference point of porous portion in shadow mask original plate.

(2) Second reference point which horizontally left several mm in approaching to the perpendicular center line of porous portion from reference point.

(3) Perpendicular peripheral line edge of porous portion which is perpendicularly from reference point in reverse direction for the level center line of porous portion.

(4) Second perpendicular peripheral line edge of porous portion which is perpendicularly from second reference point in reverse direction for the level center line of porous portion.

(means 2B) Or, the width of the bridge proportionally decreases in the second range in addition to aforesaid means 1B in the second reference point direction from the reference point side.

In addition, shadow mask type color cathode ray tube by this invention may include following composition in order to achieve the aforesaid purpose.

(means 3A) In addition to aforesaid means 1A, the diameter of the electron beam passage hole proportionally increases in the third range of substantially quadrangular state surrounded by next 4 points in the third reference point direction from reference point side.

(1) Reference point of porous portion in shadow mask original plate.

(2) Third reference point which perpendicularly left several mm in approaching to the level center line of porous portion from reference point.

(3) Horizontal peripheral line edge of porous portion which is horizontally from reference point in reverse direction for the perpendicular center line of porous portion.

(4) Second horizontal peripheral line edge of porous portion which is horizontally from third reference point in reverse direction for the perpendicular center line of porous portion.

(means 3B) Or, the width of the bridge proportionally decreases in the third range in addition to aforesaid means 1B in the third reference point direction from reference point side.

According to the aforesaid, substantially round shape dot state electron beam passage hole approaching the corner edge in the corner region of porous portion are of gradually reduced diameter. Or, there are gradually expanded bridge width portions approaching the corner edge. Therefore, the strength of the corner region of porous portion rises, as compared to the prior art, as it is close to the corner edge. As the result, the extension deformation of the aperture is suppressed, even if the considerably big transformability is applied in dot state electron beam passage holes in the corner region in composing the shadow mask unitedly by the press shaping. Then, it can be stopped that the diameter of each substantially round shape dot state electron beam passage hole expands in the corner region of the shadow mask. Electron beam cross section maintains the shape which is approximate to the substantially round shape, since the dot state electron beam passage hole is substantially circular in the corner region. Then, in a color cathode ray tube using such shadow mask, the landing tolerance of the electron beam is sufficiently ensured, and there is no degradation of the color purity of the image, and the high-quality image display can be carried out.

DESCRIPTION OF THE PREFERRED EMBODIMENTS

Figure 1:
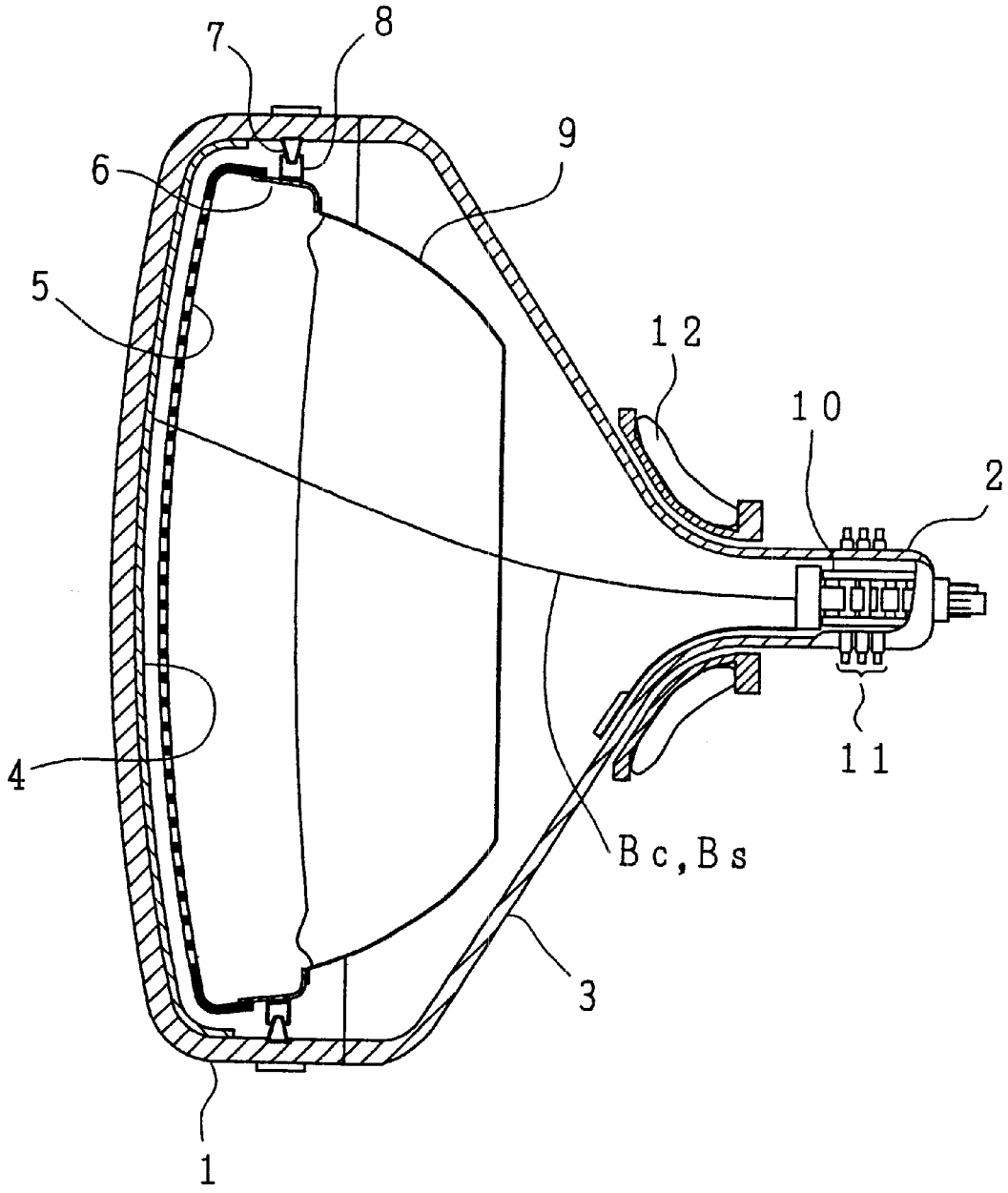
FIG. 1 is a sectional view which shows summary composition of one practical example of a shadow mask type color cathode ray tube of this invention.

The practical example of this invention is explained in detail by the reference of the drawing.

FIG. 1 is a sectional view which shows summary composition of one practical example of shadow mask type color cathode ray tube which is related to this invention.

The vacuum glass envelope which constitutes the color cathode ray tube includes panel portion 1 with face plate of the substantially rectangle state, slender and cylindric neck portion 2 with inline electron guns 10 in the inside, and funnel portion 3 of the infundibulate state which substantially connects panel portion I with neck portion 2. Fluorescent screen 4 is formed in the inner surface of face plate of panel portion 1. The skirt part of shadow mask 5 is fixed by welding in support frame 6, and mask spring 8 is installed at 4 edges in support frame 6, for example. Shadow masks 5 are placed in order to panel pin 7 that it adhered in the inner circumference of panel portion 1 put mask spring 8 in the section, and in order to face for fluorescent screens 4 each other. Magnetic shielding 9 is installed in support frame 6, and it is placed in the inside of panel portion 1 approach of funnel portion 3. Inline electron gun 10 is stored and placed in the inside of neck portion 2. Magnetic devices 11 for convergence and color purity compensation are established and are placed together in the circumference of neck portion 2. Deflection yoke 12 is fixed in the circumference of neck portion 2 approach of funnel portion 3. Center electron beam Bc and 2 side electron beams Bs projected from inline electron gun 10 are deflected in deflection yoke 12 in the fixed direction, and it strikes through large number of dot state electron beam passage holes of shadow mask 5 in fluorescent screen 4, and the color image of the requirement is displayed on fluorescent screen 4.

The image display operation of color cathode ray tube of this practical example is omitted from the description, because it is well known.

Figure 4:
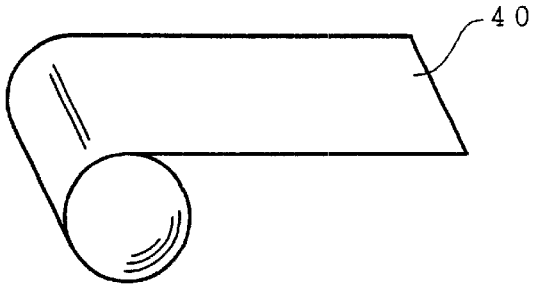
FIG. 4(*a*)~FIG. 4(*e*) show the manufacturing process of the shadow mask of FIG. 1.
Figure 4:
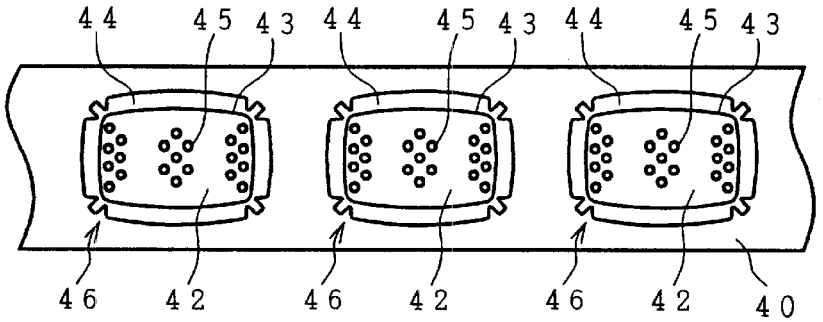
Figure 4:
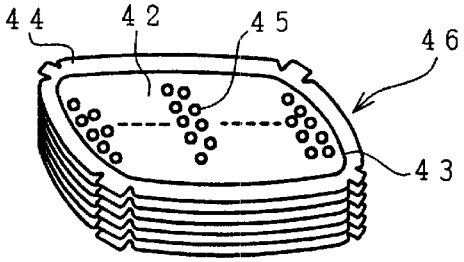
Figure 4:
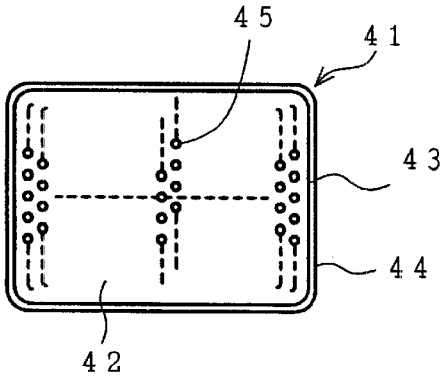
Figure 4:
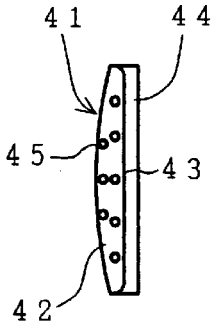

FIG. 4(*a*)~FIG. 4(*e*) is the configuration which shows the manufacturing process of the shadow mask. FIG. 4(*a*) is appearance figure of the metallic material for the shadow mask composition, FIG. 4(*b*) is the plan of the metallic material for the shadow mask composition which formed the shadow mask composition pattern, FIG. 4(*c*) is a strabismus figure of a large number of plane shadow mask original plates, and FIGS. 4(*d*) and 4(*e*) are plan and side-views of the shadow mask.

Using FIG. 4(*a*)~FIG. 4(*e*), each process in producing the shadow mask is explained.

For the beginning, metallic materials 40 for the shadow mask 41 composition are made of the iron-nickel (Fe—Ni) alloy (the Invar material) and in the form of thin plate, as it be shown by FIG. 4(*a*).

Next, by using the photography for metallic materials 40, as shown by FIG. 4(*b*), a large number of shadow mask original plates 46 are formed continuously. Shadow mask original plate of 46 contains substantially rectangle porous portion 42 and rectangle frame nonporous portion 43 of narrow width which attends whole circumference edge of porous portion 42. By the etching process, a large number of dot state electron beam passage holes 45 have been formed within porous portion 42 of shadow mask original plate 46.

This electron beam passage hole 45 have penetrated the original plate. That is to say, electron beam passage hole 45 has been connected by the part that the original plate has not been penetrated, and it is arranged in the fixed interval (pitch). Within the original plate in porous portions 42, the part which connects adjoining electron beam passage holes 45 is called a bridge (no penetration part).

Next, annealing, levelling or surface treatment are carried out for shadow mask original plate 46, as shown by FIG. 4(*c*). Afterwards, plane shadow mask original plate 46 is bored, and the conformer is done.

Each shadow mask original plate 46 is individually pressed and is shaped by the press to the shape shown by FIGS. 4(*d*) and 4(*e*) to include skirt portion 44, and thereby the shadow mask with the aforesaid composition has been composed unitedly.

Figure 2:
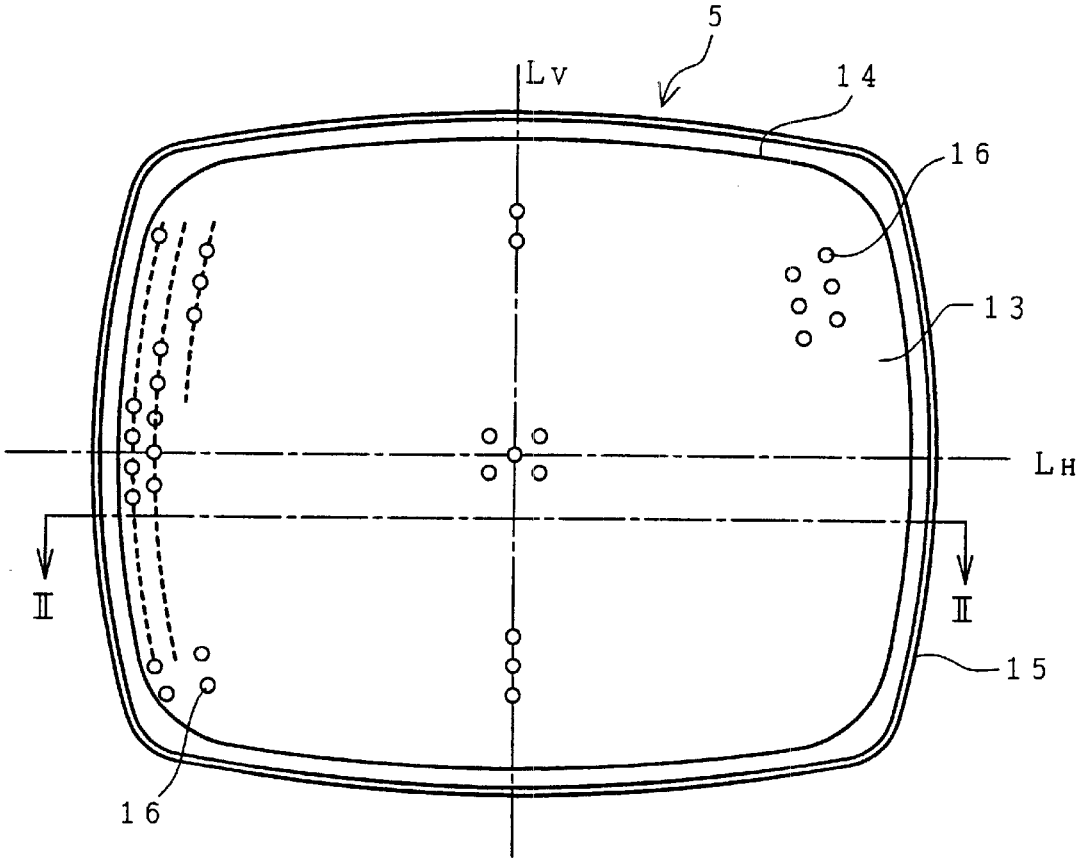
FIG. 2(*a*) and FIG. 2(*b*) show an example of a shadow mask for color cathode ray tube of this practical example illustrated in FIG. 1, and FIG. 2(*a*) is plan, and FIG. 2(*b*) is sectional view taken on II—II line of FIG. 2(*a*).
Figure 2:
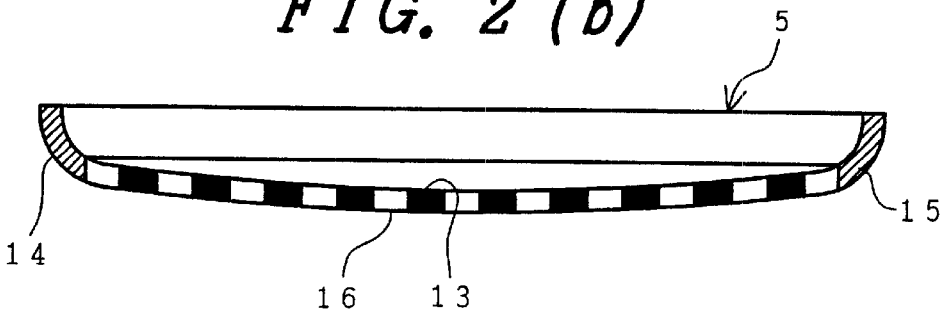

FIG. 2(*a*) and FIG. 2(*b*) show an example of shadow mask 5 for the color cathode ray tube of this practical example illustrated in FIG. 1.

Porous portion 13 constitute the essential part of shadow mask 5. It is substantially rectangle has the whole fixed surface curved, and a large number of substantially round shape dot electron beam passage holes 16 in the full face. Nonporous portion 14 attends the whole circumference edge of porous portion 13, and it is a substantially rectangle frame of narrow width with a curved surface equal to porous portion 13. Skirt part 15 is of a band form, bent along a peripheral line of nonporous portion 14 to the hanging direction. Then, skirt part 15 is fixed by the spot welding in support frame 6, which is not illustrated.

Shadow mask 5 is produced by the formation process of known shadow mask 41 illustrated at FIG. 4(*a*)~FIG. 4(*d*). After shadow mask original plate is formed with the large number of electron beam passage holes in the porous portion as illustrated at FIG. 4(*c*), shadow mask 5 which is composed of porous portion 13, nonporous portion 14 and skirt part 15 is formed unitedly by pressing and shaping this shadow mask original plate.

Figure 3:
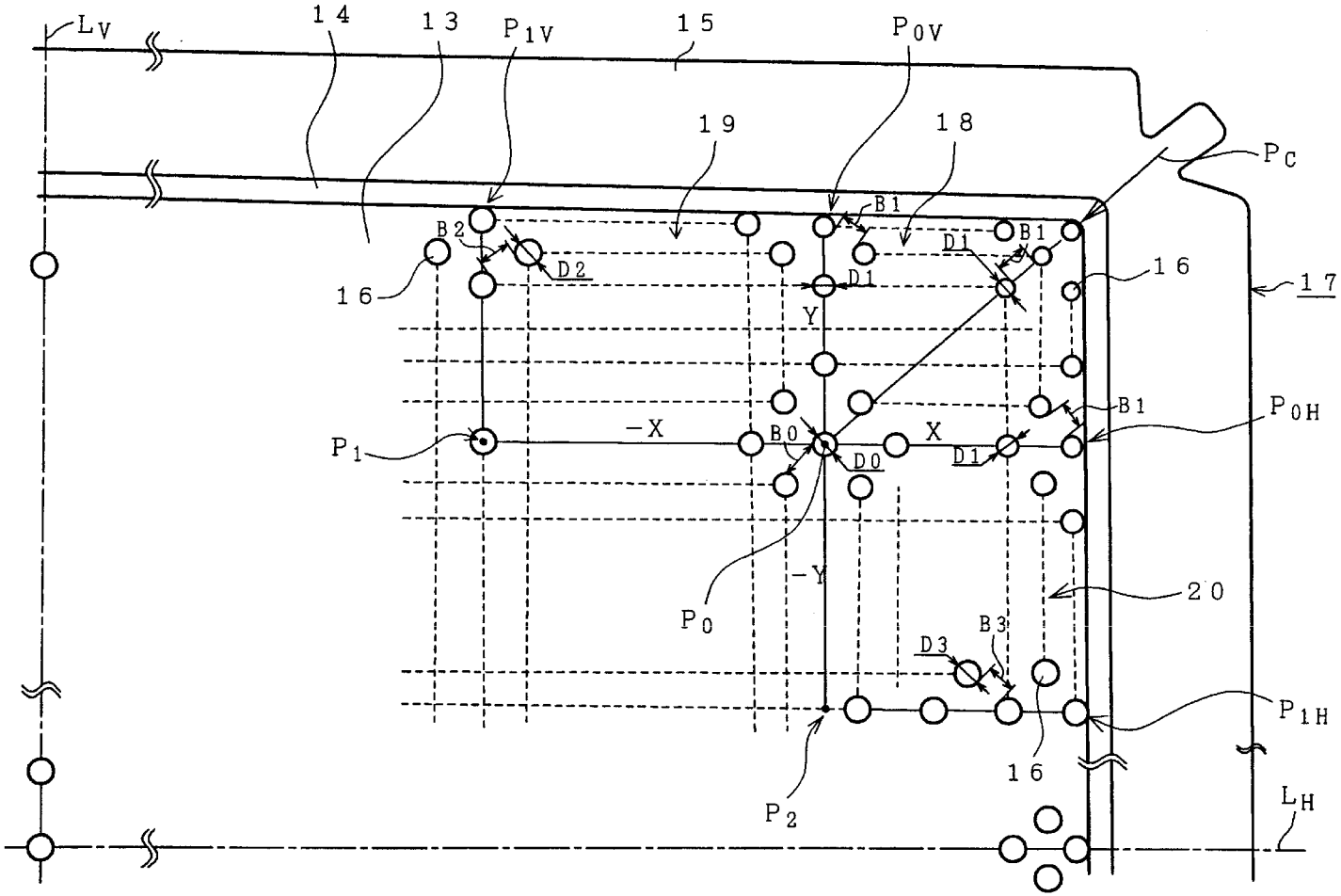
FIG. 3 is a part plan which shows an example of a shadow mask original plate used in forming the shadow mask illustrated at FIG. 2(*a*) and FIG. 2(*b*).

FIG. 3 is a part plan which shows example of shadow mask original plate 17 used in forming shadow mask 5 illustrated at FIG. 2(*a*) and FIG. 2(*b*), and it shows one corner region in shadow mask original plate 17.

In FIG. 3, shadow mask original plate 17 has first range 18 of substantially quadrangular state, second range 19 of substantially quadrangular state, third range 20 of substantially quadrangular state, and in addition, the equal code is kept on the component equal to FIG. 1, FIG. 2(*a*) and FIG. 2(*b*).

Shadow mask original plate 17 is flat substantially rectangle shape, and it contains substantially rectangle porous portion 13 that has a large number of substantially circular shape dot electron beam passage holes 16 over the range with wide center and nonporous portion 14 of substantially rectangle frame of narrow width, which attends the whole circumference edge of the porous portion 13. Skirt portion 15 obtained in shadow mask 5 by pressing and shaping shadow mask original plate 17 is included in nonporous portion 14.

First range 18 of substantially quadrangular state is the range surrounded by the following four points.

(1) Corner edge Pc of porous portion 13.

(2) Reference point P0 which left 4 mm along the diagonal line direction of porous portion 13 from corner edge Pc.

(3) Horizontal peripheral line edge P0H of reverse direction for perpendicular center line LV of porous portion 13 from reference point P0 horizontally.

(4) Perpendicular peripheral line edge P0V of reverse direction for horizontal center line LH of porous portion 13 from reference point P0 perpendicularly.

Second range 19 of the substantially quadrangular state is the range surrounded by the following four points.

(1) Reference point P0.

(2) Second reference point P1 which horizontally left 4 mm in approaching to perpendicular center line LV of porous portion 13 from reference point P0.

(3) Perpendicular peripheral line edge P0V of reverse direction for horizontal center line LH of porous portion 13 from reference point P0 perpendicularly.

(4) Second perpendicular peripheral line edge P1V of reverse direction for horizontal center line LH of porous portion 13 from second reference point P1 perpendicularly.

Third range 20 of the substantially quadrangular state is the range surrounded by the following four points.

(1) Reference point P0.

(2) Third reference point P2 which perpendicularly left 4 mm in approaching to horizontal center line LH of porous portion 13 from reference point P0.

(3) horizontal peripheral line edge P0H of reverse direction for perpendicular center line LV of porous portion 13 from reference point P0 horizontally.

(4) Second horizontal peripheral line edge P1H of reverse direction for perpendicular center line LV of porous portion 13 from third reference point P2 horizontally.

Each dot state electron beam passage hole 16 established in first range 18 of substantially quadrangular state are set in order to satisfy the next equation.

$$D1=D0-\{A1\times\sqrt{(X^2+Y^2)}\}^{1.5}$$

$$B1=B0+\{A1\times\sqrt{(X^2+Y^2)}\}^{1.5}$$

D0: Diameter of electron beam passage hole which is nearest to reference point P0.

B0: Bridge width of shadow mask that is nearest to reference point and is adjoining for the oblique direction.

X: Horizontal distance which approaches to horizontal peripheral line edge P0H from reference point P0.

Y: Vertical distance which approaches to perpendicular peripheral line edge P0V from reference point P0.

D1: Diameter of dot state electron beam passage hole 16 in arbitrary position in first range 18 of quadrangular state substantially.

B1: Bridge width of two dot state electron beam passage holes 16 which adjoins for oblique direction in arbitrary position in first range 18 of substantially quadrangular state.

A1: Constant.

Still, in this practical example, it is chosen at A1=8.944×$10^{-4}$, and reference point P0 has left 4 mm from corner PC.

Like this, each dot electron beam passage hole 16 established in first range 18 of substantially quadrangular state are respectively set in order to have the relation in which diameter D1 and bridge width B1 change power 1.5 of the distance from reference point P0. In comparison with diameter of dot state electron beam passage hole 16 which is the closest to reference point P0, diameter of dot state electron beam passage hole 16 which is the closest to corner edge PC reduces only 0.010 mm, if it is done like this,. In the meantime, bridge width of two dot state electron beam passage holes 16 which is the closest to corner edge PC can increase only 0.010 mm in comparison with bridge width of two dot state electron beam passage holes 16 which is the closest to reference point P0.

Each dot state electron beam passage hole 16 established in second range 19 of substantially quadrangular state are set in order to satisfy the next equation.

$$D2=D0-\{A2\times(-X)\times Y\}$$

$$B2=B0+\{A2\times(-X)\times Y\}$$

D0: Diameter of electron beam passage hole which is the nearest to reference point P0.

B0: Bridge width of shadow mask that is the nearest to reference point P0 and is adjoining for the oblique direction.

−X: Horizontal distance which approaches to second reference point P1 (perpendicular center line LV) from reference point P0.

Y: Vertical distance which approaches to perpendicular peripheral line edge P0V from reference point P0.

D2: Diameter of dot state electron beam passage hole 16 in arbitrary position in second range 19 of quadrangular state substantially.

B2: Bridge width of two dot state electron beam passage holes 16 which adjoins for oblique direction in arbitrary position in second range 19 of substantially quadrangular state.

A2: Constant.

Still, in this practical example, it is chosen at A2=4.43×$10^{-4}$, and second reference point P1 has left 4 mm from reference point P0.

Like this, each dot electron beam passage hole 16 established in second range 19 of substantially quadrangular state are respectively set so that diameter D2 and bridge width B2 may be in the proportional relation at the distance from reference point P0. Diameter D2 of dot state electron beam passage hole 16 is proportionally increased, as it is approached to perpendicular center line LV from reference point P0, if it is done like this. In the meantime, bridge width B2 of two dot state electron beam passage holes 16 is proportionally decreased, as it is approached to perpendicular center line LV from reference point P0.

Each dot state electron beam passage hole 16 established in third range 20 of substantially quadrangular state are set in order to satisfy the next equation.

$$D3=D0-\{A3\times X\times(-Y)\}$$

$$B2=B0+\{A3\times X\times(-Y)\}$$

D0: Diameter of electron beam passage hole which is the nearest to reference point P0.

B0: Bridge width of shadow mask that is the nearest to reference point P0 and is adjoining for the oblique direction.

X: Horizontal distance which approaches to horizontal peripheral line edge P0H from reference point P0.

−Y: Vertical distance which approaches to third reference point P2 (horizontal center line LH) from reference point P0.

D3: Diameter of dot state electron beam passage hole 16 in arbitrary position in third range 20 of quadrangular state substantially.

B3: Bridge width of two dot state electron beam passage holes 16 which adjoins for oblique direction in arbitrary position in third range 20 of substantially quadrangular state.

A3: Constant.

Still, in this practical example, it is chosen at A3=4.43×$10^{-4}$, and third reference point P2 has left 4 mm from reference point P0.

Like this, each dot electron beam passage hole 16 established in third range 20 of substantially quadrangular state are respectively set so that diameter D3 and bridge width B3 may be in the proportional relation at the distance from reference point P0. Diameter D3 of dot state electron beam passage holes 16 proportionally increases, as it is approached to horizontal center line LH from reference point P0, if it is done like this. In the meantime, bridge width B3 of two dot state electron beam passage holes 16 is proportionally decreased, as it is approached to horizontal center line LH from reference point P0.

In the aforesaid practical example, though it is explained diameter and bridge width of each dot state electron beam passage hole 16 that was equipped in one corner region of shadow mask original plate 17, it is completely set with similarly to aforesaid 1 corner region in other three corner regions.

The strength of corner region of porous portion 13 strengthens, because shadow mask original plate 17 has been set in order to be above-mentioned. Then, it is possible to efficiently stop that dot state electron beam passage hole 16 established at the each first to third region 18~20 of substantially quadrangular state expand and transforms it, when shadow masks 5 were composed unitedly by pressing and shaping shadow mask original plate 17. And, electron beam cross section maintains the shape which is approximate to the substantially round shape, since dot state electron beam passage hole 16 is substantially circular in the corner region. Then, in this color cathode ray tube using shadow mask 5, landing tolerance of the electron beam is sufficiently ensured, and it is possible that there is no degradation of the color purity of the image, and that it carries out the high-quality image display.

Still, in porous portion 13 of the aforesaid practical example of shadow mask original plate 17, it is set at the position where reference point P0 separated from corner edge PC in the diagonal line direction at 4 mm, and it is set at the position where second reference point P1 horizontally left 4 mm from reference point P0, and it has been set at the position where third reference point P2 perpendicularly down 4 mm from reference point P0. However, it is not limited to the each above-mentioned case, and each setting position of reference point P0, second reference point P1, and third reference point P2 in this invention is possible to choose in 2~4 mm range in proportion to outer diameter dimension of the diagonal line direction of shadow masks 5 of porous portion 13 properly.

And, it has been set in the aforesaid practical example, as diameter and bridge width of each dot state electron beam passage hole 16 is above-mentioned in each corner region (first to third region 18~20 of quadrangular state each substantially) of porous portion 13 in shadow mask original plate 17. However, the setting of diameter and bridge width of each dot state electron beam passage hole 16 by this invention is not limited to the case with above-mentioned. That is to say, it may be set in first region 18, first region 18 and second region 19, or first region 18 and third region 20 so that aforesaid diameter and bridge width may change, as it is above-mentioned.

In addition, only the diameter of each dot state electron beam passage hole 16 may be set, as it is above-mentioned, if the extension of the diameter of each corner region of porous portion 13 of each dot state electron beam passage hole 16 in pressed and shaped shadow mask 5 can be allowed a little. And, only bridge width of each dot state electron beam passage hole 16 may be set, as it is above-mentioned.

Like the above, the diameter of dot state electron beam passage hole in the corner region of porous portion of shadow mask original plate is gradually reduced with approaching the corner edge according to this invention. Or, it is gradually expanded with the bridge width approaching the corner edge. Therefore, when the shadow mask is formed by pressing and shaping shadow mask original plate, it rises as the strength of the corner region of porous portion is close to the corner edge. As the result, it is suppressed that it is transformed so that the diameter may expand, even if the considerably big transformability is applied in dot state electron beam passage hole in the corner vicinity in composing the shadow mask unitedly by the press shaping. Then, it can be stopped that the diameter of each dot state electron beam passage hole in the corner vicinity of the shadow mask expands.

Again, in color cathode ray tube using such shadow mask, landing tolerance of the electron beam is sufficiently ensured, and there is the effect that there is no degradation of the color purity of the image and it carries out the high-quality image display is possible.

The holes may be other shapes than circular, for example, they may be elliptical, squared, or slots extending for a full width or height of the shadow mask. The curvature created by pressing of FIGS. 4(*a*) to 4(*e*) may be as shown or produce a unidirectional curvature, such as cylindrical.

What is claimed is:

1. A shadow mask type color cathode ray tube, comprising:

an envelope including a panel portion with a face plate, a neck portion, and a funnel portion which connects the panel portion with the neck portion, a fluorescent screen in the face plate, an electron gun in the neck portion, a deflection yoke fixed on the funnel portion, a shadow mask placed so as to face the fluorescent screen in the panel portion, onto which an original plate with a substantially rectangular porous portion is pressed and shaped, the porous portion establishing many electron beam passage holes, and the diameter of the electron beam passage holes being smaller in corner regions of the porous portion than in a center region of the porous portion, wherein a first range of substantially quadrangular state is a range surrounded by four points, (1) a corner edge Pc of porous portion, (2) a reference point P0 which left along the diagonal line direction of porous portion from the corner edge Pc, (3) a horizontal peripheral line edge P0H of reverse direction for perpendicular center line of porous portion from reference point P0 horizontally, (4) a perpendicular peripheral line edge P0V of reverse direction for horizontal center line of porous portion from reference point P0 perpendicularly, wherein a diameter of electron beam passage hole in said first range have equation $$D1=D0-\{A1\times\sqrt{(X^2+Y^2)}\}^{1.5}$$

D0 is diameter of electron beam passage hole which is the nearest to reference point P0, X is horizontal distance which approaches to horizontal peripheral line edge P0H from reference point P0, Y is vertical distance which approaches to perpendicular peripheral line edge P0V from reference point P0, D1 is diameter of electron beam passage hole in arbitrary position ,in first range of quadrangular state substantially, A1 is constant.

2. A shadow mask type color cathode ray tube according to claim 1, wherein the diameter of the electron beam passage holes in the each corner region are gradually decreased approaching the corner edge.

3. A shadow mask type color cathode ray tube according to claim 1, wherein the electron beam passage holes are circular dot shape.

4. A shadow mask type color cathode ray tube according to claim 1, a bridge width (B1) in said first range has the following equation $$B1=B0+\{A1\times\sqrt{(X^2+Y^2)}\}^{1.5}$$

B0 is bridge width of two electron beam passage holes that it closes in reference point P0 most and that it is adjoining for the oblique direction, B1 is bridge width of two electron beam passage holes which adjoin for oblique direction in arbitrary position in first range of substantially quadrangular state.

5. A shadow mask type color cathode ray tube according to claim 4, the constant A1 is $8.944\times10^{-4}$, the reference point P0 left 4 mm along the diagonal line direction of porous portion from the corner edge Pc.

6. A shadow mask type color cathode ray tube according to claim 4, a second range of substantially quadrangular state is a range surrounded by four points, (1) a reference point P0, (2) a second reference point P1 which horizontally left the reference point P0 to perpendicular center line of porous portion, (3) a perpendicular peripheral line edge P0V of reverse direction for horizontal center line of porous portion from reference point P0 perpendicularly, (4) a second perpendicular peripheral line edge P1V of reverse direction for horizontal center line LH of porous portion from second reference point P1 perpendicularly, wherein a diameter of electron beam passage hole and bridge width in said second range have equations $$D2=D0-\{A2\times(-X)\times Y\}$$

$$B2=B0+\{A2\times(-X)\times Y\}$$

–X is horizontal distance which approaches to second reference point P1 from reference point P0, D2 is diameter of electron beam passage hole in arbitrary position in second range of quadrangular state substantially, B2 is bridge width of two electron beam passage holes which adjoins for oblique direction in arbitrary position in second range substantially quadrangular state, A2 is constant.

7. A shadow mask type color cathode ray tube according to claim 6, the constant A2 is $4.43\times10^{-4}$, the second reference point P1 left 4 mm in approaching to perpendicular center line of porous portion from reference point P0.

8. A shadow mask type color cathode ray tube according to claim 6,

Third range of the substantially quadrangular state is a range surrounded by four points, (1) a reference point P0, (2) a third reference point P2 which perpendicularly left the reference point P0 to horizontal center line of porous portion, (3) a horizontal peripheral line edge P0H of reverse direction for perpendicular center line of porous portion from reference point P0 horizontally, (4) a second horizontal peripheral line edge P1H of reverse direction for perpendicular center line of porous portion from third reference point P2 horizontally, wherein a diameter of electron beam passage hole and bridge width in said third range have equations $$D3=D0-\{A3\times X\times(-Y)\}$$

$$B3=B0+\{A3\times X\times(-Y)\}$$

–Y is vertical distance which approaches to third reference point P2 from reference point P0, D3 is diameter of electron beam passage hole in arbitrary position in third range of quadrangular state substantially, B3 is bridge width of two electron beam passage holes which adjoins for oblique direction in arbitrary position in third range of substantially quadrangular state, A3 is constant.

9. A shadow mask type color cathode ray tube according to claim 8, the constant A3 is $4.43\times10^{-4}$, the third reference point P2 left 4 mm in approaching to perpendicular center line of porous portion from reference point P0.

10. A shadow mask type color cathode ray tube according to claim 4,

Third range of the substantially quadrangular state is a range surrounded by four points, (1) a reference point P0, (2) a third reference point P2 which perpendicularly left the reference point P0 to horizontal center line of porous portion, (3) a horizontal peripheral line edge P0H of reverse direction for perpendicular center line of porous portion from reference point P0 horizontally, (4) a second horizontal peripheral line edge P1H of reverse direction for perpendicular center line of porous portion from third reference point P2 horizontally, wherein a diameter of electron beam passage hole and bridge width in said third range have equations $$D3=D0-\{A3\times X\times(-Y)\}$$

$$B3=B0+\{A3\times X\times(-Y)\}$$

–Y is vertical distance which approaches to third reference point P2 from reference point P0, D3 si diameter of electron beam passage hole in arbitrary position in third range of quadrangular state substantially, B3 is bridge width of two electron beam passage holes which adjoins for oblique direction in arbitrary position in third range of substantially quadrangular state, A3 is constant.

11. A shadow mask type color cathode ray tube according to claim 10, the constant A3 is $4.43\times10^{-4}$, the third reference point P2 left 4 mm in approaching to perpendicular center line of porous portion from reference point P0.

12. A shadow mask type color cathode ray tube, comprising:

an envelope including a panel portion with a face plate, a neck portion, and a funnel portion which connects the panel portion with the neck portion, a fluorescent screen in the face plate, an electron gun in the neck portion, a deflection yoke fixed on the funnel portion, a shadow mask placed to face with the fluorescent screen in the panel portion, which an original plate with a substantially rectangular porous portion is pressed and shaped, the porous portion establishes many electron beam passage holes, wherein a first range of substantially quadrangular state is a range surrounded by four points, (1) a corner edge Pc of porous portion, (2) a reference point P0 which left along the diagonal line direction of porous portion from the corner edge Pc, (3) a horizontal peripheral line edge P0H of reverse direction for perpendicular center line of porous portion from reference point P0 horizontally, (4) a perpendicular peripheral line edge P0V of reverse direction for horizontal center line of porous portion from reference point P0 perpendicularly, wherein a bridge width in said first range have equation $$B1=B0+\{A1\times\sqrt{(X^2+Y^2)}\}^{1.5}$$

B0 is bridge width of shadow mask that is the nearest to reference point and is adjoining for the oblique direction, x is horizontal distance which approaches to horizontal peripheral line edge P0H from reference point P0, Y is vertical distance which approaches to perpendicular peripheral line edge P0V from reference point P0, B1 is bridge width of two electron beam passage holes which adjoins for oblique direction in arbitrary position in first range of substantially quadrangular state, A1 is constant and the width of bridge which connects the electron beam passage holes which adjoins for oblique direction is bigger in four corner regions than a center region of the porous portion.

13. A shadow mask type color cathode ray tube according to claim 12, the width of the bridge in the four corner regions are gradually increased approaching a corner edge.

14. A shadow mask type color cathode ray tube according to claim 12 wherein the electron beam passage holes are circular dot shape.

* * * * *